US006464593B2

(12) United States Patent
Arie

(10) Patent No.: US 6,464,593 B2
(45) Date of Patent: Oct. 15, 2002

(54) AMUSEMENT PARK HAVING AN ELEVATED RACETRACK AND ASSOCIATED METHODS

(76) Inventor: John Arie, 5551 Del Verde Way, Orlando, FL (US) 32819

( * ) Notice: Subject to any disclaimer, the term of this patent is extended or adjusted under 35 U.S.C. 154(b) by 0 days.

(21) Appl. No.: 09/766,052

(22) Filed: Jan. 19, 2001

(65) Prior Publication Data

US 2001/0018370 A1 Aug. 30, 2001

Related U.S. Application Data

(63) Continuation-in-part of application No. 09/383,771, filed on Aug. 26, 1999, now Pat. No. 6,244,968.

(51) Int. Cl.[7] ..... A63K 1/00
(52) U.S. Cl. ..... 472/85; 472/89; 472/13
(58) Field of Search ..... 472/85, 88, 89, 472/90, 43, 45, 13; 104/53, 60, 124, 125; 404/1, 46

(56) References Cited

U.S. PATENT DOCUMENTS 419,860 A * 1/1890 Libbey ..... 473/243
872,253 A * 11/1907 Riehl ..... 472/43
1,713,793 A * 5/1929 Traver ..... 472/43
2,254,482 A * 9/1941 Heller ..... 472/89
3,859,682 A * 1/1975 Sulkiewicz ..... 104/124
3,861,315 A * 1/1975 Rypinski ..... 104/124

* cited by examiner

*Primary Examiner*—Kien T. Nguyen
(74) *Attorney, Agent, or Firm*—Allen, Dyer, Doppelt, Milbrath & Gilchrist, P.A.

(57) ABSTRACT

The invention discloses an amusement park comprising an elevated wooden racetrack built in combination with another park activity. The combination comprises a wooden racetrack surface extending along at least one portion elevated above ground level, and a support frame comprising a plurality of vertical supports connected to support the elevated portion above ground level, and another park facility constructed at least partially below the elevated portion of the racetrack to thereby conserve space in the amusement park. The combination includes a go-kart as the motorized amusement vehicle. The park facility constructed below the racetrack is selected from an amusement ride, a building, and a parking lot, the amusement ride being particularly a boat ride having bumper boats. An amusement ride includes a second racetrack operated at least partially below an elevated portion of the first racetrack, and sharing a pit area therewith. A method of generating revenue from the combination is also included in the invention.

16 Claims, 5 Drawing Sheets

10
10A
10B
10C
12
22
40
42
44
46
48
48A
FUN SPOT

AMUSEMENT PARK HAVING AN ELEVATED RACETRACK AND ASSOCIATED METHODS

RELATED APPLICATION

This application is a continuation-in-part of and claims priority from co-pending application Ser. No. 09/383,771, which was filed on Aug. 26, 1999 now U.S. Pat. No. 6,244,968 and which is incorporated herein by reference in its entirety.

FIELD OF THE INVENTION

The present invention relates to the field of amusement parks and, more particularly, to an amusement park having an elevated racetrack and having another park facility constructed at least partially below an elevated portion of the racetrack to thereby conserve space in the amusement park.

BACKGROUND OF THE INVENTION

Go-karts and similar motorized amusement vehicles have been popular for many years. Driving a go-cart on a suitably proportioned racetrack is a fun-filled experience for the entire family, young and old. Racetracks for go-karts have been part of the amusement park industry practically since commercially available go-karts appeared on the market. Most go-cart tracks are asphalt or concrete racetracks built at ground level, much as roads for regular vehicles.

Because of the technical difficulty and expense involved in building an elevated go-cart racetrack, fewer of these tracks have been built. In addition, building an elevated racetrack using conventional techniques, such as concrete or asphalt, greatly increases the expense of construction. Therefore, builders have turned to wood as a suitable construction material for elevated go-cart racetracks.

Land for building an amusement park is at a premium in many urban areas. It would, therefore, be advantageous to build an amusement park having a compact footprint so that the parcel of land is used most efficiently, while providing a varied number of rides and other attractions.

SUMMARY OF THE INVENTION

With the foregoing in mind, the present invention advantageously provides an amusement park comprising an elevated wooden racetrack built in combination with another park activity. The combination comprises a wooden racetrack surface extending along at least one portion elevated above ground level, and a support frame comprising a plurality of vertical supports connected to support the at least one portion elevated above ground level. Another park facility is constructed at least partially below the elevated portion of the racetrack to thereby conserve space in the amusement park. The elevated wooden racetrack described comprises at least one motorized amusement vehicle, preferably a go-kart, the vehicle passing over another park facility when operating along the elevated portion of the track. The park facility constructed under the elevated portion of the racetrack may include an amusement ride, a building, and a parking lot. In a preferred embodiment of the invention, the park facility under the elevated portion of the racetrack is a boat ride, and more preferably a bumper boat ride. Those knowledgeable in the art will know that bumper boats are somewhat similar to bumper cars in operation by the customer, except that the boats float in a pool of water, rather than moving on a solid surface. Other park facilities and functions may also be placed and operated under the elevated wooden racetrack, as will be described.

The elevated go-cart racetrack includes an elevated wooden racetrack surface supported by a structural frame anchored to the ground below. The wooden racetrack surface includes a plurality of floor boards, has a first and second outer periphery defining the outer edges of the racetrack, and extends along a plurality of tiers elevated above ground level. The wooden racetrack surface also includes a plurality of curves, preferably banked and formed from a plurality of wooden slats positioned vertically on edge and abuttingly adjoining at least one other wooden slat of said plurality. In constructing the banked curves the plurality of wooden slats is preferably positioned bent into shape and at a predetermined angle of inclination from the inside curve periphery to the outside curve periphery, thereby to define the banked curve. The wooden racetrack surface is supported on a racetrack support frame having a plurality of vertical support posts placed on suitable land and connected to a plurality of support beams and support joists and stringers acting as braces abuttingly underlying and connected directly or indirectly to the wooden racetrack surface, to thereby provide elevation above ground and structural support.

In addition, the park facility constructed under an elevated portion of the racetrack includes a stormwater retention basin. Accordingly, the invention includes a method of producing revenue from land having thereon a stormwater retention basin by operating the motorized amusement vehicle ride over the stormwater retention basin. The method includes the steps of providing at least one motorized amusement vehicle positioned on a racetrack erected over the stormwater retention basin, the racetrack sufficiently elevated above ground level such that the stormwater retention basin operates substantially within design characteristics, and allowing drivers to operate the motorized amusement vehicle for a fee, thereby producing revenue.

BRIEF DESCRIPTION OF THE DRAWINGS

Some of the features, advantages, and benefits of the present invention having been stated, others will become apparent as the description proceeds when taken in conjunction with the accompanying drawings in which.

DETAILED DESCRIPTION

Figures 1, 2:
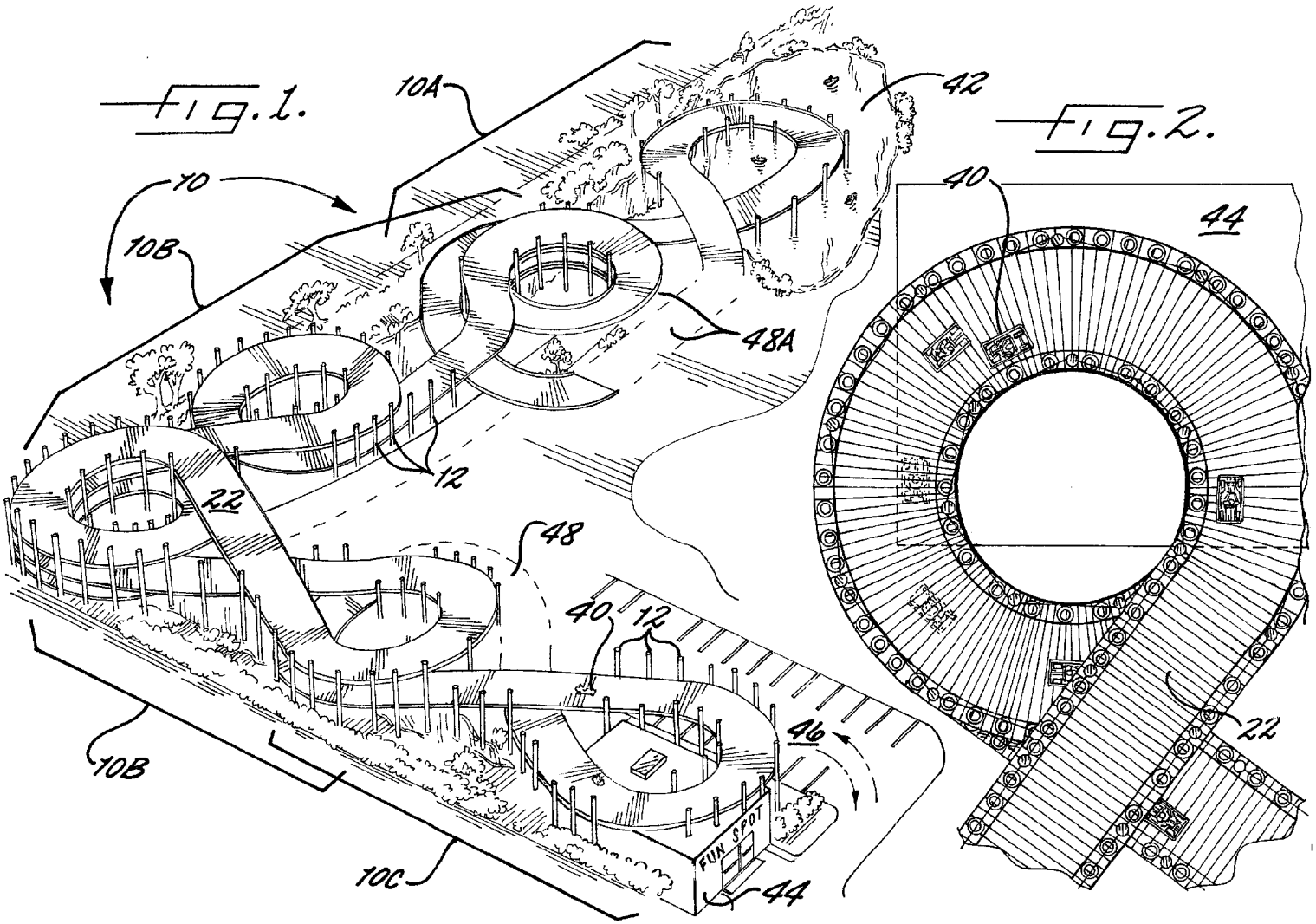
FIG. 1 is an overall perspective view of an amusement park having an elevated wooden racetrack with other park facilities thereunder according to an embodiment of the present invention.
FIG. 2 is a top plan view of a three-level spiral curve built with conventional construction methods and having a park building thereunder.

The present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art.

FIGS. 1 through 8 illustrate a racetrack for operating motorized amusement vehicles thereon. The racetrack includes an elevated wooden racetrack 10 supported on a frame having a plurality of vertical support posts 12, best shown in FIGS. 1 and 5. As used herein and known to those skilled in the art, the terms for the various members included in the support frame are intended to generally have the following meanings. Vertical support posts 12, shown in FIGS. 1, 4, 5, and 7, are vertically oriented support members having one end sunk into the ground and the other end at a sufficient height to meet the design and engineering requirements for providing support for the elevated track 10. Beam supports 16 are substantially horizontal support members connected to posts 12 and serving to sustain the various beams.

Figures 6, 7:
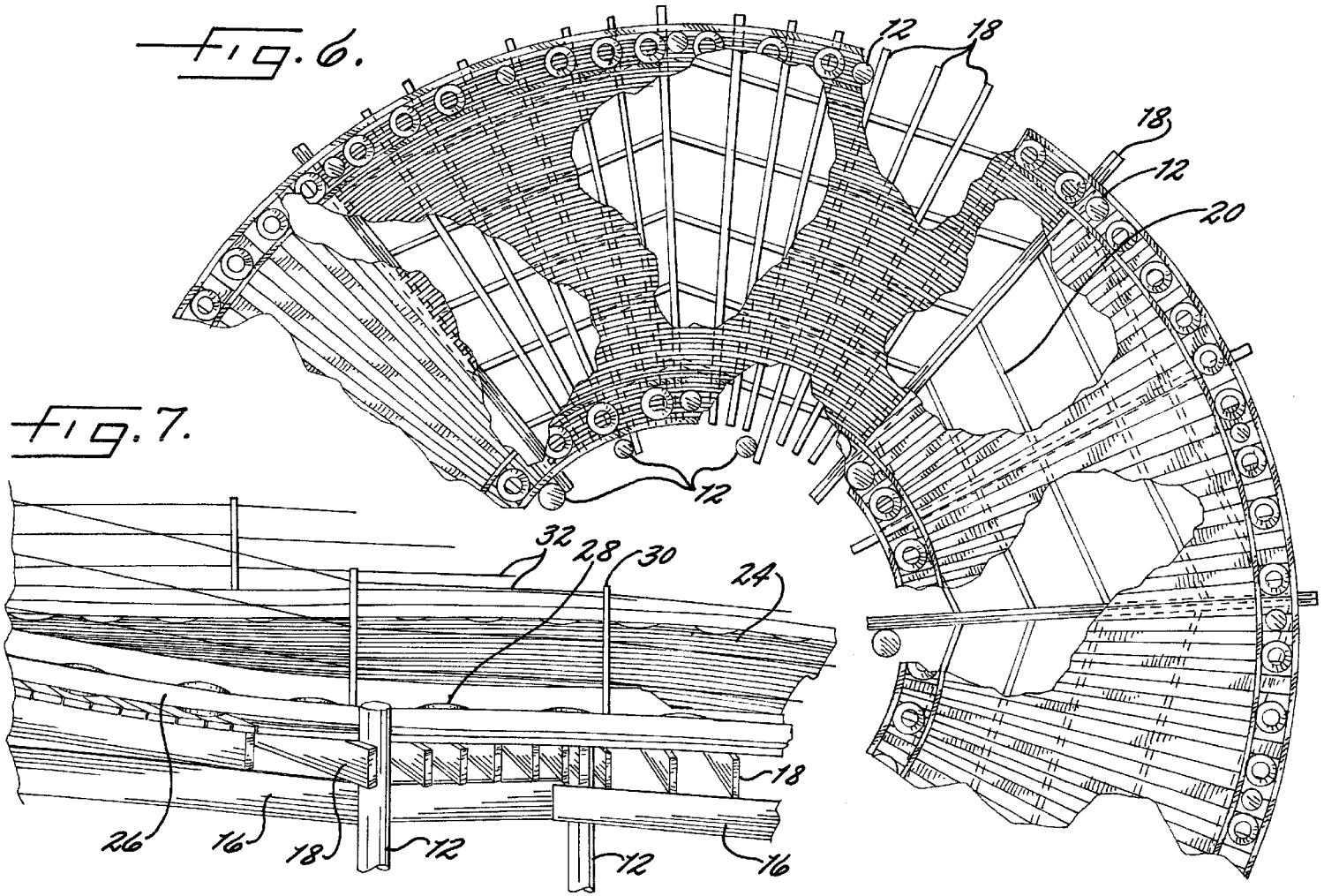
FIG. 6 is a top plan cutaway view showing construction detail showing two types of curve construction.
FIG. 7 is a side perspective view showing construction detail of the elevated wooden racetrack.

Beam supports 16 are preferably boards having a nominal size of two-by-twelve (2×12). Beams are substantially horizontal support members running generally perpendicular to the track, and connected to posts 12 and/or to beam supports 16. Beams 18 may be subdivided into two categories, depending on how they are connected in the support frame. Primary beams are connected to at least two posts, generally positioned directly opposite each other along the track, as seen in FIG. 6. Primary beams are preferably made by joining a plurality of boards to form a laminated beam, also as seen in FIG. 6.

Secondary beams are connected to beam support members 16, or to a post 12 and a beam support member 16. Beams are generally members having a nominal size of two-by-twelve (2×12). Joists 20 are generally horizontal support members running substantially parallel to the track and abuttingly connected to beams, preferably through the use of joist hangers, as known in the art. Stringers are generally horizontal support members running parallel to the track but which, unlike joists 20, are connected to beams by being positioned on top of the beams, usually standing on edge. Joists 20 and stringers are substantially equivalent support members and may be used essentially interchangeably. Joists and stringers are generally either two-by-six (2×6) or two-by-twelve (2×12).

Figures 3, 4:
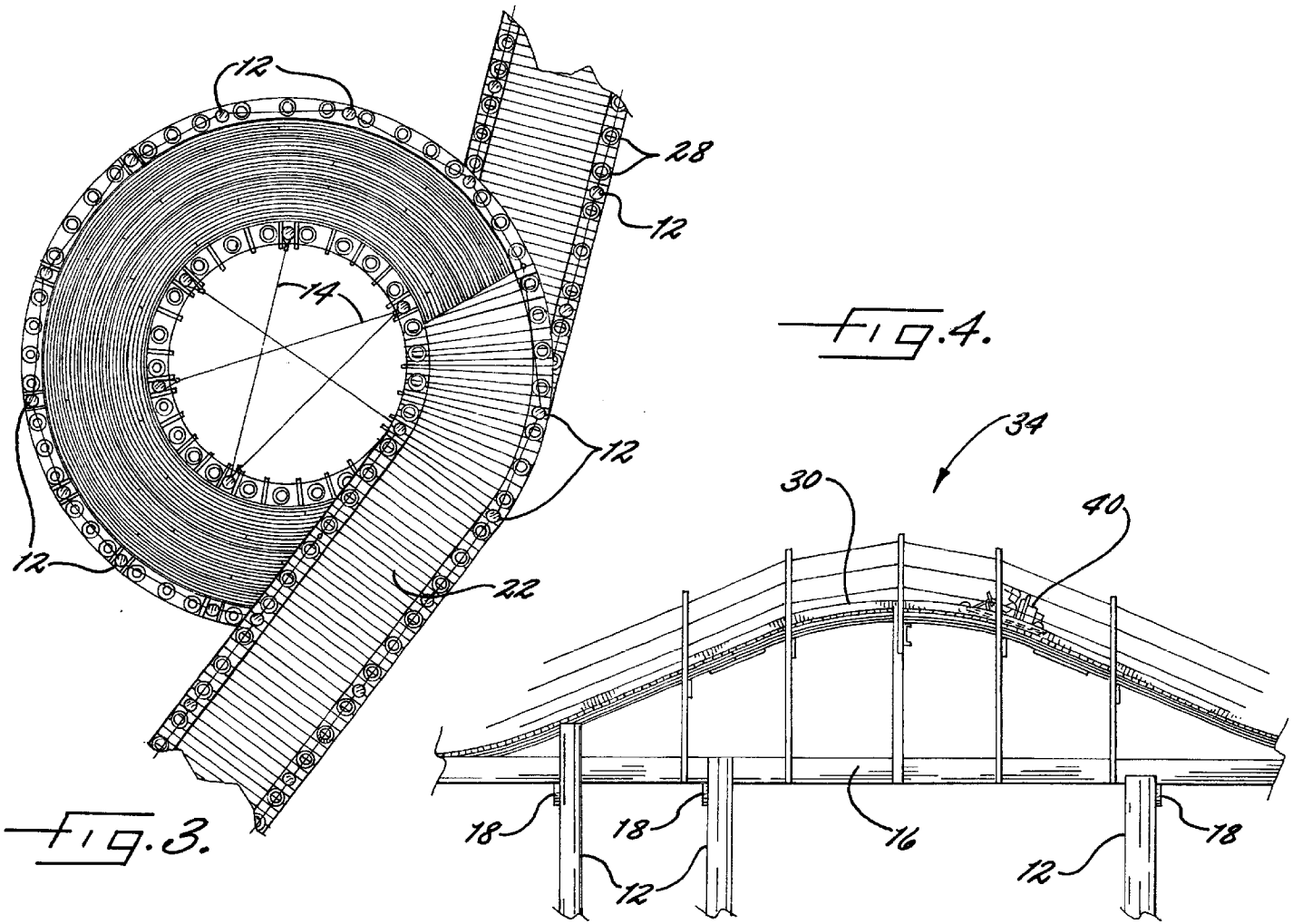
FIG. 3 shows a top plan view of a single-level spiral curve.
FIG. 4 is a side elevation showing an arched bridge section of the elevated wooden track.

The posts 12, in a preferred embodiment of the racetrack, are substantially similar to wooden telephone poles. The vertical support posts 12 may be stabilized by any method known to those skilled in the art, and are preferably sunk into the ground to a depth sufficient to provide stability for the support frame. The posts 12 may be also further stabilized by being connected to the ground and to each other by supporting cables 14, as shown in FIG. 3. It is to be understood that the posts may be further stabilized by being set in concrete, rock gravel, and the like. The vertical support posts 12 are connected to a plurality of support members, as variously shown in FIGS. 4, 6 and 7.

In constructing the elevated racetrack the support beams 18 and support joists 20 may be positioned abuttingly underlying and directly or indirectly connected to the wooden racetrack surface 22, as best shown in FIG. 7, thereby providing elevation above ground and structural support for the wooden racetrack surface 22. The whole assembly of vertical support posts 12, beams 18, joists 20 and stringers forms an interconnected network of support members which collectively make up the racetrack support frame.

The elevated racetrack includes a wooden racetrack surface 22, best seen in FIGS. 2, 3 and 6, connected to and supported by the racetrack support frame. The wooden racetrack surface 22 has a first and second outer periphery, forming the side edges of the track surface, and extends along a plurality of tiers elevated above ground level, creating the multi-level racetrack surface 22 shown in FIGS. 1 and 5.

Figure 5:
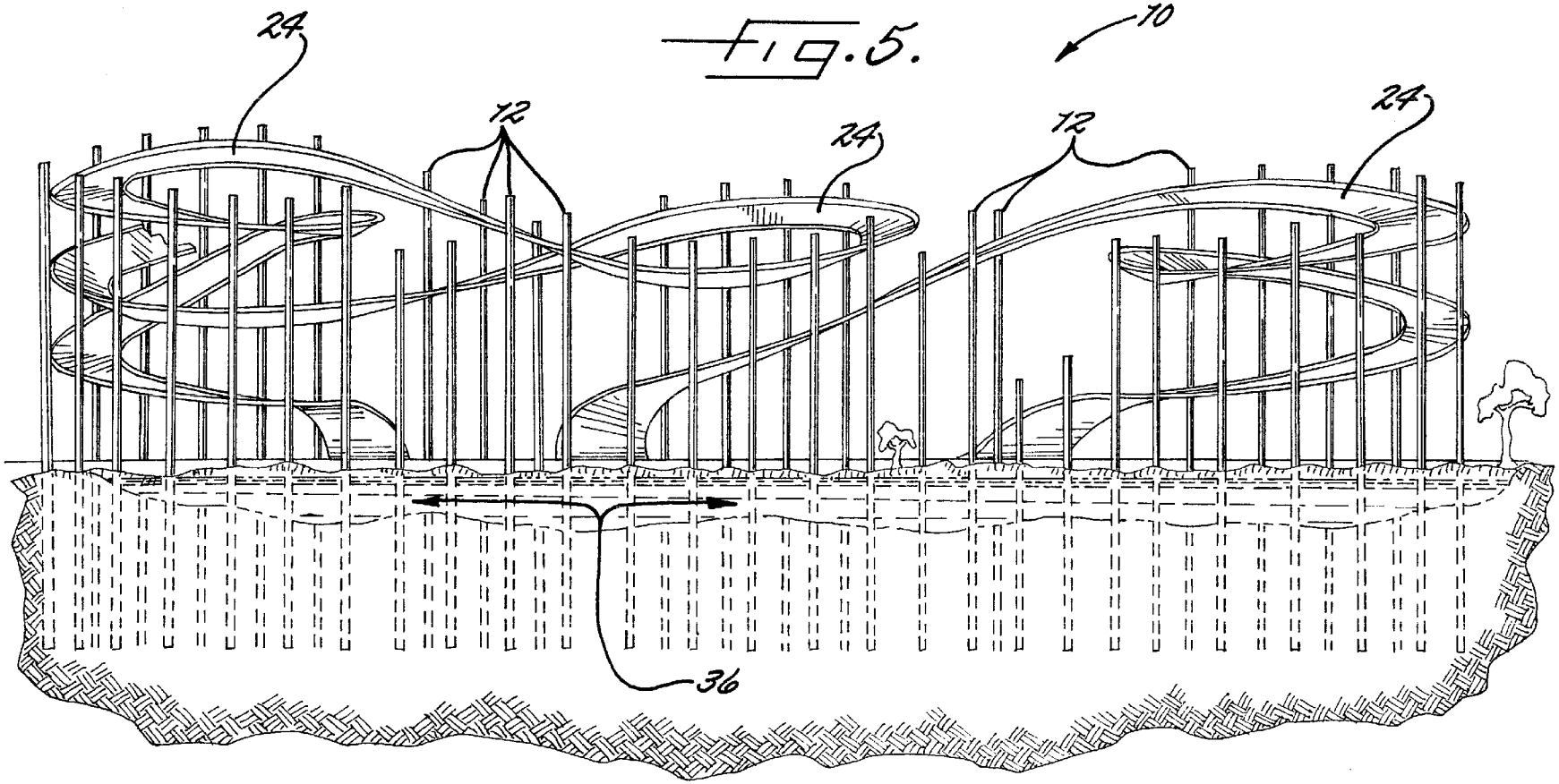
FIG. 5 is an overall side elevation illustrating the elevated wooden racetrack having a stormwater retention basin and a building under elevated portions of the track.

In addition, the wooden racetrack surface 22 preferably includes a plurality of banked curves 24, at times forming spirals, as illustrated in FIG. 5. Each banked curve 24 defines at least part of the circumference of an imaginary circle having a predetermined center. The first outer periphery of the banked curve 24 is positioned toward the center of the imaginary circle so as to define an inside curve periphery. The second outer periphery of each banked curve 24 is positioned toward the circumference of the imaginary circle so as to define an outside curve periphery for the curve. The plurality of tiers of the racetrack is constructed in the airspace above the parcel of land with multiple levels of generally concentric circles defined by the banked racetrack curves, each circle having a predetermined center with an axis of all the centers extending through the parcel of land, as can be seen in FIGS. 1 and 5.

Each banked curve 24 may be constructed in a conventional manner, as illustrated in FIG. 2. However, a banked curve is preferably formed by a plurality of wooden slats positioned vertically on edge and abuttingly adjoining at least one other wooden slat of the plurality, as shown in FIGS. 3 and 6, producing a surface resembling the typical surface of a bowling alley. The on edge positioning of the wooden slats to form banked curves 24 is a novel approach to such construction. The on edge structure of the surface results in a very smooth banked curved surface which is a configuration very difficult to achieve with conventional curve construction where the surface boards are laid flat. Such conventional curve construction is illustrated in FIG. 2. The plurality of on edge wooden slats is positioned bent into shape and at a predetermined angle of inclination from the inside curve periphery to the outside curve periphery, thereby defining the banked curve 24.

Figure 8:
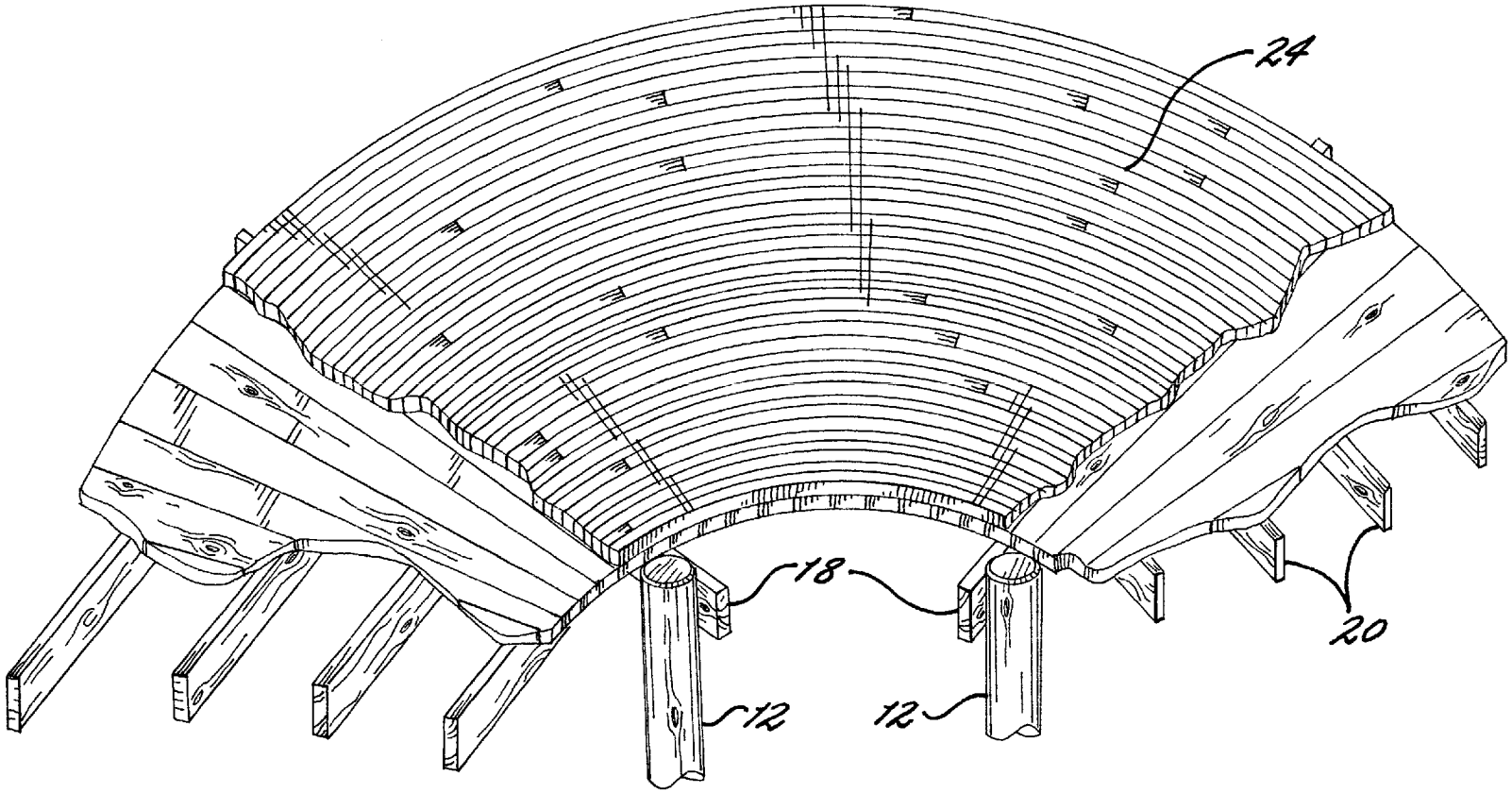
FIG. 8 illustrates a banked curve constructed of on edge wooden slats overlying a layer of wood planks.

The curves may be banked at a predetermined angle varying from approximately 10 to 35 degrees of inclination, depending on the design of the racetrack. In addition, the plurality of banked curves 24 may include at least one layer of wood positioned between the plurality of wooden slats and the plurality of support members, so as to provide an underlying, unifying structural foundation for the plurality of wooden slats, thereby adding great structural strength to the banked curves 24. The layer of wood may preferably be a laminated wood product such as plywood, or may simply be a conventional planked surface as shown in FIG. 8. This arrangement also allows for reconstruction of a conventionally built curve by overlaying an existing conventional curve with on edge wooden slats. The plurality of banked curves 24 may be combined with straightaway sections of racetrack to create turns, ovals, figure eights, multi-level spirals, or any other desired shape, as generally shown in FIG. 1.

Several further aspects of a preferred embodiment of the invention will now be described with reference to the accompanying figures. First, it will be apparent to those skilled in the art that a preferred wood for building the present invention is pressure treated timber or other weather resistant wood. The vertical support posts 12, in particular, must be resistant to deterioration brought about by ground contact, including wood destroying organisms such as termites. The motorized amusement vehicles are preferably go-karts 40 operating on the racetrack, as illustrated in FIGS. 2 and 4. The racetrack also preferably includes a shock absorbing guard rail 26 positioned along at least one outer periphery of the wooden racetrack surface 22, thereby to absorb the shock of an impact produced by one of the motorized amusement vehicles. The shock absorbing guard rail 26 may include tires 28 as a resilient, shock absorbing material, best shown in FIGS. 2, 3 and 6. In a preferred embodiment the tires 28 are old discarded tires from small aircraft, which can be obtained inexpensively, are particularly strong, and have a relatively small diameter, thus taking up less space along the edge of the racetrack surface 22. The tires 28 are provided with drainage holes drilled through whichever side of the tire will face down on the racetrack, thereby helping prevent accumulation of rain water within the tire cavity. The shock absorbing guard rail 26 may be low, resembling a curb as shown in FIGS. 6 and 7, or may be taller depending on preference or the characteristics of the particular racetrack. In addition, the racetrack preferably includes a safety fence 30 positioned along the first and second outer peripheries, or sides of the wooden racetrack surface 22. The safety fence 30 preferably includes a plurality of safety wires 32 connected to the vertical support posts 12 and positioned along the first and second outer peripheries of the wooden racetrack surface 22, thereby serving as a retaining safety fence 30 to prevent the motorized amusement vehicles from accidentally leaving the wooden racetrack surface 22. Such a safety fence 30 is best shown in side elevation in FIG. 7.

The racetrack surface 22 may have other topographical features to provide a variable terrain tending to promote amusement in the operator of the vehicle. For example, the wooden racetrack surface 22 preferably includes at least one arched bridge 34 section positioned to form an overpass above at least another portion of the wooden racetrack surface 22, a feature shown in FIG. 4. Vehicle operators passing the arched bridge 34 will experience an exhilarating sensation similar to that produced when cresting a hill on a highway, including the slight pull of gravity forces on the way up the hill and the sudden drop in gravity at reaching and passing the crest. A wooden arched bridge 34 is very difficult to build using conventional techniques to create a smooth and even transition up to the crest of the bridge and down thereafter. A feature of the invention particularly useful for construction of such bridges is a laminated support beam including a plurality of wooden boards connected to each other so as to form the laminated support beam. The laminated support beam is positioned connected to and underlying the wooden racetrack surface 22 creating the bridge, thereby providing very strong structural support. Advantageously, the plurality of wooden boards making up this laminated beam is staggered in position relative to each other, so as to create a support beam having a hump along one edge, thereby providing an underlying support structure for the arched bridge which allows the wooden racetrack surface 22 to be smooth and fully supported at the crest of the arch.

The present invention discloses an amusement park comprising the described elevated wooden racetrack 10 built in combination with another park activity. The combination includes a wooden racetrack surface 22 extending along at least one portion elevated above ground level, and a support frame comprising a plurality of vertical supports 12 connected to support the at least one portion elevated above ground level, and another park facility constructed at least partially below the elevated portion of the racetrack to thereby conserve space in the amusement park. As described above, the racetrack 10 includes at least one motorized amusement vehicle 40, preferably a go-kart, the vehicle passing over another park facility when operating along the elevated portion of the racetrack.

As best shown in FIG. 1, the amusement park of the present invention includes another park facility constructed and operated under an elevated portion of the racetrack. The other park facility could include an amusement ride 42, a building 44, and a parking lot 46. For example, a boat ride 42 requiring a pool of water can be operated under an elevated portion of the racetrack, as shown on the right side of FIG. 1. The boat ride preferably comprises bumper boats as known in the trade. A building 44 is shown constructed in the space below an elevated portion of the racetrack 10.

In the combination, the other park facility constructed and operated under an elevated portion of the racetrack could be a second racetrack, separate from but intertwined with the first racetrack. The park facility located under an elevated portion of the racetrack could also be a pit area 48 where customers begin and end the go-kart ride. The pit area 48 may be shared with an adjacent second racetrack separate from the elevated wooden racetrack, the second racetrack being at ground level or also comprising elevated portions. As can be appreciated by careful examination of FIG. 1, three separate but adjacent and intertwined tracks 10A, 10B and 10C are shown. Racetracks 10A and 10B share pit area 48A.

The entrance to the park may preferably include a building 44 constructed at least partially on land below an elevated portion of the racetrack, thereby saving space on the parcel of land. A building constructed below an elevated portion of the racetrack may also be positioned elsewhere in the park and have a variety of other uses related to the park's operation. For example, a building 44 underlying the racetrack 10 would be an ideal location for a game arcade drawing customers finishing their go-kart ride. A retail store for souvenirs, or a food concession would be additional possible operations located in the building under the racetrack. For example, a retail shop could have a racing theme associated with the go-kart track and sell auto racing novelties, memorabilia, and other related items. Additionally, the amusement park's entrance could be constructed and operated under an elevated portion of the racetrack. Such an arrangement would catch the public's attention, serving substantially as an advertisement for the amusement park, and tending to draw more customers into the park.

One particularly advantageous embodiment of the invention includes a parking lot 46 constructed at least partially on land below an elevated portion of the racetrack 10C, a feature shown in FIG. 1. As previously noted, parcels of land sufficiently large for an amusement park are difficult to find in urban areas. These parcels are also usually very expensive, therefore, it is important to construct the amusement park to efficiently use the available space, thereby producing as much income as possible per unit area.

The present invention also includes method aspects, including a method for generating revenue by operating a motorized amusement vehicle track in an airspace over a parcel of land used for another purpose different from the operation of the motorized amusement vehicle track. The method comprises installing a plurality of vertical support posts about at least a peripheral portion of the parcel of land, the support posts extending into the airspace a sufficient vertical distance to support a plurality of tiers of a racetrack, fixing a racetrack for the motorized amusement vehicles to the vertical support posts along a plurality of tiers into the airspace above the level of the parcel of land, constructing the plurality of tiers of the racetrack in the airspace above the parcel of land with multiple levels of generally concentric circles defined by banked racetrack curves, each circle having a predetermined center with an axis of all the centers extending through the parcel of land, and allowing paying customers to operate motorized amusement vehicles over the racetrack to thereby generate revenue.

The method includes constructing the racetrack with a generally non-circular portion of the racetrack extending away from the concentric circles and into a second parcel of land adjacent the first parcel, and installing customer ingress and egress facilities in the second parcel. Additionally, the method comprises constructing the racetrack with a generally non-circular portion of the racetrack extending away from the concentric circles, and installing customer ingress and egress facilities in the non-circular portion.

Other aspects of the method include constructing the banked racetrack curves so that each banked curve comprises a plurality of wooden slats positioned on edge along a lengthwise dimension of the wooden slat and abuttingly adjoining at least one other wooden slat of the plurality, the plurality of wooden slats positioned bent into shape and at a predetermined angle of inclination from an inside curve periphery to an outside curve periphery, thereby forming the banked racetrack curve. Further, the method comprises constructing the plurality of tiers of the racetrack in the airspace above a stormwater retention basin on the parcel of land, so that the motorized amusement vehicle track is operated at least in part above the stormwater retention pond.

Additionally, great commercial utility for this invention is found in a method of producing revenue from land having a stormwater retention area thereon, by constructing and operating a motorized amusement vehicle ride above the stormwater retention area or pond 36, as shown in FIG. 5. The invention embodied in this method allows generating income from this otherwise unproductive parcel of land. Environmental regulations are such that stormwater retention ponds are now usually required for commercial building projects to help prevent direct discharge of pollutants into local streams and lakes. The project developer is thus faced with having to reserve part of the available land for use as the stormwater retention pond, which completely restricts the use of that land, decreasing available revenue from the property. A working installation of this invention has obtained required environmental permits and is successfully operating directly over such a stormwater retention area, thereby creating additional income for the owner of the property. This arrangement is best illustrated in FIG. 5. This method could be employed anywhere there is a stormwater retention area on commercially zoned property, and could be a particularly profitable addition to a mall or large shopping center.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

That which is claimed:

1. An elevated wooden go-kart track built on a parcel of land in combination with a building and a boat ride, the combination comprising:

a) a wooden go-kart track surface comprising a plurality of portions elevated above ground level, and a go-kart track support frame comprising a plurality of vertical support posts connected to support the go-kart track surface;

b) a building constructed at least partially on land underlying at least one elevated portion of the go-kart track; and c) a boat ride comprising a body of water and at least one boat thereon, the boat ride located and operating at least partially underlying at least one elevated portion of the wooden go-kart track to thereby conserve space on the parcel of land.

2. The combination of claim 1, further comprising a second go-kart track separate from said first-recited elevated wooden go-kart track.

3. The combination of claim 2, further comprising a pit area shared between said second go-kart track and said first-recited elevated wooden go-kart track.

4. The combination of claim 1, further comprising at least one motorized amusement go-kart passing over said building and said boat ride when operating along an elevated portion of said track.

5. The combination of claim 1, wherein said boat ride comprises a plurality of bumper boats.

6. The combination of claim 1, wherein said boat ride comprises at least one self-propelled boat.

7. A method for generating revenue by operating a motorized go-kart amusement track in an airspace over a parcel of land used for a purpose different from the operation of the motorized go-kart amusement track, the method comprising:

installing a plurality of vertical support posts about at least a peripheral portion of the parcel of land, the support posts extending into the airspace a sufficient vertical distance to support a plurality of tiers of a go-kart track;

fixing a track for the motorized amusement go-karts to the vertical support posts along a plurality of tiers into the airspace above the level of the parcel of land;

constructing the plurality of tiers of the go-kart track in the airspace overlying the parcel of land with multiple levels of generally concentric circles defined by banked go-kart track curves, each circle having a predetermined center with an axis of all the centers extending through the parcel of land;

constructing a boat ride with a body of water on the parcel of land underlying at least one of the concentric circles; and allowing paying customers to operate motorized amusement go-karts over the track and boats on the boat ride to thereby generate revenue.

8. The method of claim 7, further comprising:

constructing the go-kart track with a generally non-circular portion of the track extending away from the concentric circles and into a second parcel of lang adjacent the first parcel; and installing customer ingress and egress facilities in the second parcel.

9. The method of claim 7, further comprising:

constructing the go-kart track with a generally non-circular portion of the track extending away from the concentric circles; and installing customer ingress and egress facilities in the non-circular portion.

10. The method of claim 7, further comprising the step of constructing the banked go-kart track curves so that each banked curve comprises a plurality of wooden slats positioned on edge along a lengthwise dimension of the wooden slat and abuttingly adjoining at least one other wooden slat of the plurality, the plurality of wooden slats positioned bent into shape and at predetermined angle of inclination from an inside curve periphery to an outside curve periphery, thereby forming the banked go-kart track curve.

11. The method of claim 7, further comprising the step of constructing the plurality of tiers of the go-kart track in the airspace above a stormwater retention area on the parcel of land, so that the motorized amusement go-kart track is operated at least in part above the stormwater retention area.

12. A combination of non roller coaster amusement rides, said combination comprising:

a first amusement ride having a go-kart track including at least one elevated go-kart track portion, and a support frame having a plurality of supports connected to support the elevated track portion above ground with sufficient clearance for operating another amusement ride under the elevated track portion;

a second amusement ride having a body of water extending under the elevated go-kart track portion of said first amusement ride and having on said body of water at least one amusement water craft operable under the elevated go-kart track portion; and at least one motorized amusement go-kart operating on said track, the go-kart passing over said second amusement ride when the go-kart is operating along the elevated portion.

13. The combination of claim 12, wherein said amusement water craft comprises a boat.

14. The combination of claim 12, wherein said at least one amusement water craft further comprises a bumper boat.

15. The combination of claim 12, wherein said amusement water craft comprises propulsion.

16. A combination of amusement rides, said combination comprising;

a first amusement ride having a go-kart track surface suitable for operating a go-cart thereon, said track surface extending along a plurality of elevated tiers having banked curves, a support frame having a plurality of supports connected to support the elevated tiers above ground with sufficient clearance for operating a second amusement ride under the elevated tiers;

a second amusement ride including a body of water extending under the banked curves of the elevated tiers of said first amusement ride and having on said body of water at least one amusement water craft operable under the elevated tiers; and wherein said at least one amusement water craft further comprises a bumper boat.

* * * * *